US008979608B2

(12) United States Patent
Hawthorne

(10) Patent No.: US 8,979,608 B2
(45) Date of Patent: Mar. 17, 2015

(54) FOLDED BLOCK STRUCTURE AND METHOD FOR MAKING

(75) Inventor: Grace Huang Hawthorne, Mill Valley, CA (US)

(73) Assignee: Lo-Res Labs LLC, Mill Valley, CA (US)

( * ) Notice: Subject to any disclaimer, the term of this patent is extended or adjusted under 35 U.S.C. 154(b) by 229 days.

(21) Appl. No.: 13/480,851

(22) Filed: May 25, 2012

(65) Prior Publication Data

US 2012/0309258 A1 Dec. 6, 2012

Related U.S. Application Data

(60) Provisional application No. 61/520,097, filed on Jun. 6, 2011.

(51) Int. Cl.
*A63H 33/08* (2006.01)
*A63H 33/16* (2006.01)
*A63H 33/04* (2006.01)

(52) U.S. Cl.
CPC ..... *A63H 33/16* (2013.01); *A63H 33/04* (2013.01)
USPC ..... 446/109

(58) Field of Classification Search
CPC ..... A63H 33/08; A63H 33/16
USPC ..... 446/85, 87, 108, 109, 478, 487, 488
See application file for complete search history.

(56) References Cited

U.S. PATENT DOCUMENTS 550,563 A 11/1895 Pierce, Jr.
1,292,188 A * 1/1919 Wheeler ..... 446/85
2,454,307 A * 11/1948 Cooley ..... 52/591.3
3,368,316 A * 2/1968 Crowder ..... 52/592.1
3,666,607 A * 5/1972 Weissman ..... 428/33
3,702,520 A * 11/1972 Huber et al. ..... 52/284
4,133,538 A 1/1979 Ambrose
4,254,574 A 3/1981 Stock
4,778,392 A 10/1988 Mitchell
4,965,106 A * 10/1990 DeChristopher ..... 428/34.2
4,976,652 A * 12/1990 Schwartz ..... 446/488
5,125,867 A * 6/1992 Solomon ..... 446/488
5,162,010 A 11/1992 Krebs (Continued)

OTHER PUBLICATIONS

Papercraft box; http://4volt.com/Blog/archive/2008/12/18/32.aspx; downloaded from the internet on Apr. 5, 2012; 1 page.

(Continued)

*Primary Examiner* — Kurt Fernstrom

(74) *Attorney, Agent, or Firm* — James F. Hann; Haynes Beffel & Wolfeld LLP

(57) ABSTRACT

A kit for creating a folded block structure comprises a set of blanks to create different shaped folded blocks without the need to use adhesive or cutting tools. Each blank includes sides, the sides having edges, the edges comprising side edges, tab edges and flap edges. The sides are joined to one another along adjacent side edges. Folds lines are at the side edges. The tab extends from each of the tab edges. Tab fold lines are at the tab edges. A flap extends from each of the flap edges. Flap fold lines are at the flap edges. A tab slit at or near each of the flap folds lines is configured for receipt of corresponding ones of the tabs. Notches may be formed at the ends of the tabs. Adhesive elements can be used to adhere folded blocks to one another to create a folded block structure.

26 Claims, 6 Drawing Sheets

(56) References Cited

U.S. PATENT DOCUMENTS

| | | | | |
|---|---|---|---|---|
| 5,489,230 | A * | 2/1996 | Gavula, Jr. | 446/109 |
| 5,597,112 | A | 1/1997 | Knapp | |
| 5,662,508 | A * | 9/1997 | Smith | 446/128 |
| 5,846,114 | A * | 12/1998 | Frandsen, II | 446/106 |
| 5,895,306 | A * | 4/1999 | Cunningham | 446/108 |
| 6,626,732 | B1 | 9/2003 | Chung | |
| 6,921,314 | B2 * | 7/2005 | Miller | 446/85 |
| 7,018,690 | B2 * | 3/2006 | Lee | 428/36.5 |
| 7,022,387 | B1 | 4/2006 | Fertig | |
| 7,452,211 | B1 | 11/2008 | Helsel | |
| 7,625,261 | B2 | 12/2009 | Andersen | |
| 8,286,402 | B2 * | 10/2012 | Fleishman | 52/588.1 |
| 2002/0106471 | A1 | 8/2002 | Kuo et al. | |
| 2005/0236464 | A1 | 10/2005 | Cohen | |
| 2007/0293126 | A1 | 12/2007 | Yoon | |
| 2008/0207082 | A1 * | 8/2008 | Warner | 446/111 |

OTHER PUBLICATIONS

Dodecahedron and Truncated Tetrahedron; www.korthalsaltes.com; downloaded from the Internet on Apr. 5, 2012; 1 page.

Box Guide for folded box; downloaded from the internet on Apr. 5, 2012; 1 page.

* cited by examiner

FOLDED BLOCK STRUCTURE AND METHOD FOR MAKING

CROSS-REFERENCE TO OTHER APPLICATIONS

This application claims the benefit of U.S. Provisional Patent Application No. 61/520,097 filed on 6 Jun. 2011 entitled "Paper Toy Building Block."

BACKGROUND OF THE INVENTION

The invention is related generally to toy building sets comprising toy building elements and to toys which require assembly, more particularly to folded paperboard toy building blocks that are created by a user from flat sheets with predetermined fold lines and pre-cut lines to easily fold into hollow three-dimensional folded blocks.

Three-dimensional building blocks are commonly prebuilt and made of solid, dense material (wood, plastic). These building elements are heavy and not easily transportable.

Paper toys designed to be cut, folded, and glued into a three-dimensional shape, are often pre-played, meaning that the toy has a predetermined result. This typically occurs when a paper toy is pre-printed with a particular character design providing a narrow scope for the resulting toy with a preconceived structural outcome (for example, make only a monkey) with no variation. In addition, regarding decorative designs on toys, the toys typically are offered finished and complete with an endpoint to the design already printed on the toy. The user, whether a child or an adult, often has no input on the decorative aspects of the toy.

SUMMARY OF THE INVENTION

An example of the invention is directed to a paperboard toy composed of fold-to-play hollow building blocks, typically referred to as folded blocks in this application, that are created from flat blanks on one or more shape sheets. The blanks detach from the shape sheet(s) without using separate cutting tools for detachment. The detached blanks can be built into three-dimensional shapes using a slit and tab connection system. The resulting folded blocks can be adhered to each other with, for example, provided adhesive dots, in any configuration as selected by the user to create a folded block structure. The folded blocks or the folded block structure, or both, can be decorated with, for example, stickers in any manner selected by the user, thereby enabling the creation of a wholly unique toy form by the user.

In some examples, the slit and tab connection allows the use of flat packed, easily detachable pre-scored, pre-die-cut shape sheets, which can be easily built into hollow folded blocks used to create one or more folded block structures. In some examples, the use of adhesive, such as adhesive dots, permits the user to join folded blocks to one another in various manners to make individualized folded block structures and thus toy forms unique to the user. Stickers or other ornamentation can be used to customize the exterior of the folded block structures.

The present invention has a versatile, open play aspect that allows the user to build a suggested folded block structure type of toy or a toy of their own imagination (ie: robot, car, tree, cake, etc.).

Various examples of the present invention provide for a building block, typically in the form of a paperboard folded block, which can provide for a fold-to-play experience from a pre-scored, perforated, die-cut flat piece of paperboard into hollow, three-dimensional building block with a slit and tab interface that requires no adhesive. Construction is easy and quick without the need for additional materials or tools and also provides a unique hands-on educational experience in the fields of design, math and engineering.

An example of a kit for creating a folded block structure comprises a set of blanks shaped to create a plurality of different shaped folded blocks without the need to use adhesive. Each blank includes sides, the sides having edges, the edges comprising side edges, tab edges and flap edges. The sides are joined to one another along adjacent ones of said side edges. Folds lines are at the side edges. The tab extends from each of the tab edges. Tab fold lines are at the tab edges. The flap extends from each of the flap edges. Flap fold lines are at the flap edges. A tab slit is at or near each of the flap folds lines, the tab slits being configured for receipt of corresponding ones of the tabs. In some examples, a plurality of tabs extends from at least one tab edge. In some examples, for each tab edge there is a corresponding flap edge. In some examples, the tab fold lines have ends and notches formed between the tabs and the tab edges at the ends of the tab fold lines. In some examples, the kit comprises adhesive elements placeable between a plurality of said folded blocks to create a folded block structure with said plurality of folded blocks adhesively secured to one another.

An example of a method for making a folded block structure kit for assembly by a user is carried out as follows. Shapes for a plurality of folded blocks are selected. The folded blocks are usable for the creation of at least one folded block structure without the need for the use of a cutting tool or an adhesive to create the folded blocks. For each folded block a blank is created, the blank comprising (1) sides corresponding to the side surfaces of the folded block, the sides having edges, the edges comprising side edges, tab edges and flap edges, the sides joined to one another along adjacent ones of said side edges, (2) tabs extending from each of the tab edges, and (3) flaps extending from each of the flap edges. Side folds lines are created along the side edges. Tab fold lines are created along the tab edges. Flap folds lines are created along the flap edges. Tab slits are formed at or near each of the flap folds lines. The tabs and the tab slits are configured for receipt of corresponding ones of the tabs by the tab slits. A folded block structure kit is assembled using the blanks for the folded blocks. In some examples, the method further includes creating instructions (1) to aid a user in the creation of the folded blocks, and (2) to aid user in the creation of a folded block structure from the folded blocks, the kit further comprising the instructions. Some examples further comprise providing the kit with an adhesive element, such as adhesive dots, for securing folded blocks, created by the user from the blanks, to one another to create a folded block structure. In some examples, the instructions creating step comprises instructing the user regarding the use of an adhesive element to create the folded block structure.

Other features, aspects and advantages of the present invention can be seen on review the drawing, the detailed description, and the claims which follow.

DETAILED DESCRIPTION OF THE INVENTION

Figure 1:
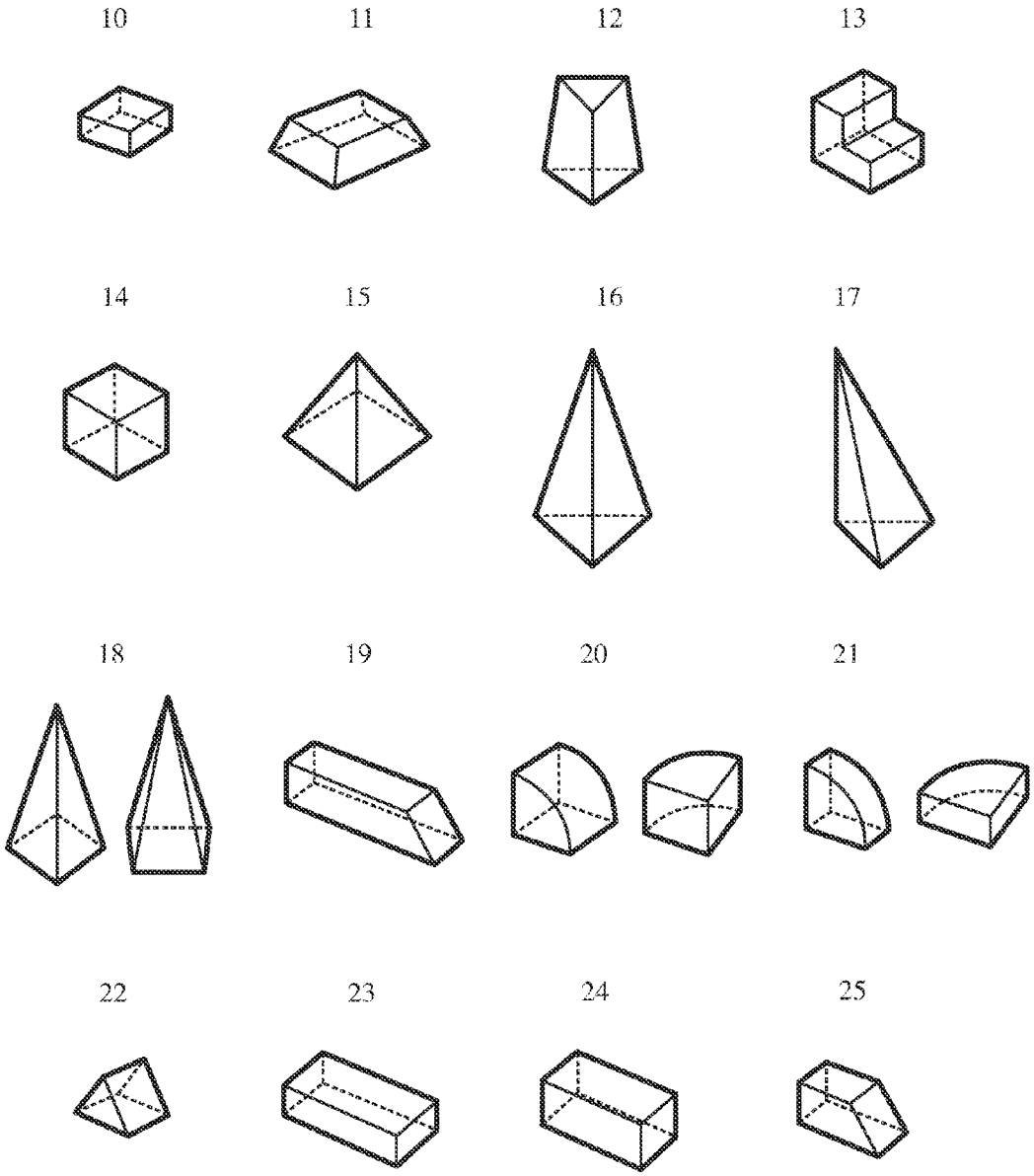
FIG. 1 shows a set of examples of folded blocks typical of the different shapes of folded blocks which can be made according to the invention.
Figure 2:
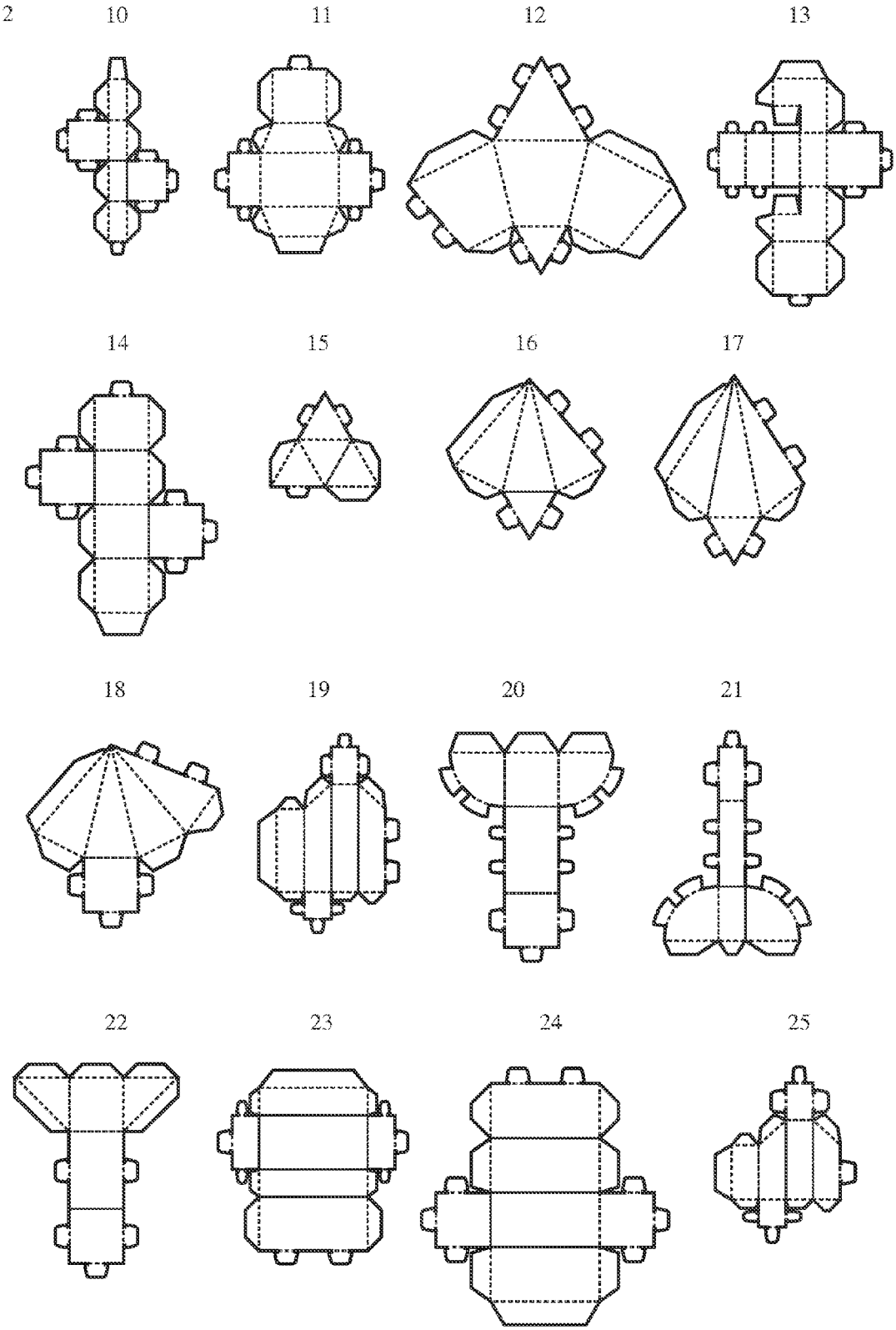
FIG. 2 illustrates plan views of the set of blanks from which the folded blocks of FIG. 1 are constructed.

FIG. 1 illustrates a number of different folded blocks identified as folded block 10, folded block 11, through folded block 25. In this application, a folded block will be referred to generically as folded block FB. These are examples of different shapes of folded blocks FB that can be used with different examples of the present invention. Other shapes of folded blocks FB can also be used. FIG. 2 shows plan views of blanks identified as blank 10, blank 11, through blank 25. In this application, a blank will be referred to generically as blank B. Blanks 10-25 are used to make folded blocks 10-25 as will be described below. A number of different folded blocks FB can be combined to create a folded block structure. One example of a folded block structure is described below with reference to FIG. 4. Note that a kit for creating a folded block structure may include more folded blocks FB that are necessary for a particular folded block structure.

Figure 3:
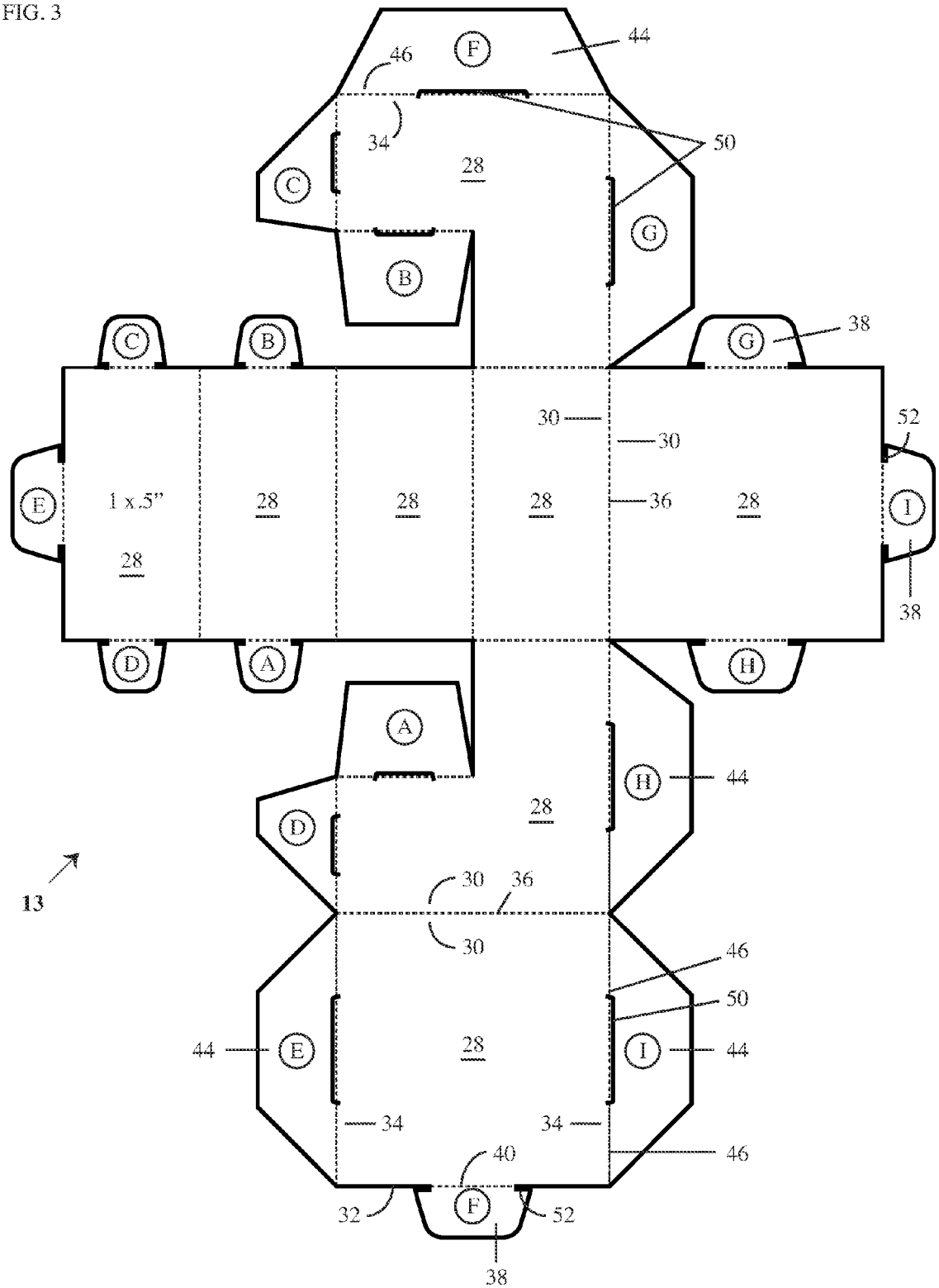
FIG. 3 is an enlarged plan view of blank 13 of FIG. 2.

With specific reference to blank 13 of FIG. 3, blanks B include sides 28 having different types of edges, referred to as side edges 30, tab edges 32 and flap edges 34. Sides 28 are joined to one another, typically as a continuous sheet of material, along side edges 30. Pre-creased side fold lines 36 are preferably formed along the joined side edges 30. Tabs 38 extend from tab edges 32 along pre-creased tab fold lines 40. Flaps 44 extend from flap edges 34 along pre-creased flap fold lines 46.

Tab slits 50 are formed at or near flap fold lines 46 and are configured for receipt of corresponding tabs 38 during the construction of folded blocks FB from blanks B. To facilitate this interaction, tabs 38 have notches 52 at either end of the tab. In this example, longer tabs are about 0.4255"×0.1863" with notches of about 0.06"×0.15", and shorter tabs are about 0.243"×0.1884 inch with notches of about 0.035"×0.15". In this example, the longer tab slits 50 have dimensions of about 0.3735 inch long by 0.015 inch wide while the shorter tab slits 50 have a length of 0.2 inch long×0.015 inch wide. These dimensions have been found suitable for paperboard having a thickness of about 300 g/m$^2$ with the sides 28 having lengths and widths in the range of about ½ inch to about 5 inches according to the particular shape.

Examples discussed herein are typically made of a thick paper-based material, typically referred to as paperboard. The material is foldable and can be creased and slit. It is also recyclable. The material can be single ply or multi ply. It can also be only partially paper-based or it can be made of a material without any paper at all but which can be folded and manipulated like paper-based paperboard. Therefore, the term paperboard includes materials suitable for creating folded blocks FB from blanks B. Is expected that folded blocks FB can be provided in a range of sizes, such as small, medium, large and extra-large having one maximum dimension of, for example, 1 inch, 1.5 inches, 2 inches, and 2.5 inches. Other sizes and ranges of sizes can also be used. Also, a particular folded block structure, such as folded block structure 58 of FIG. 4, can be, and will typically be, made using a range of different sizes of folded blocks FB.

Figure 4:
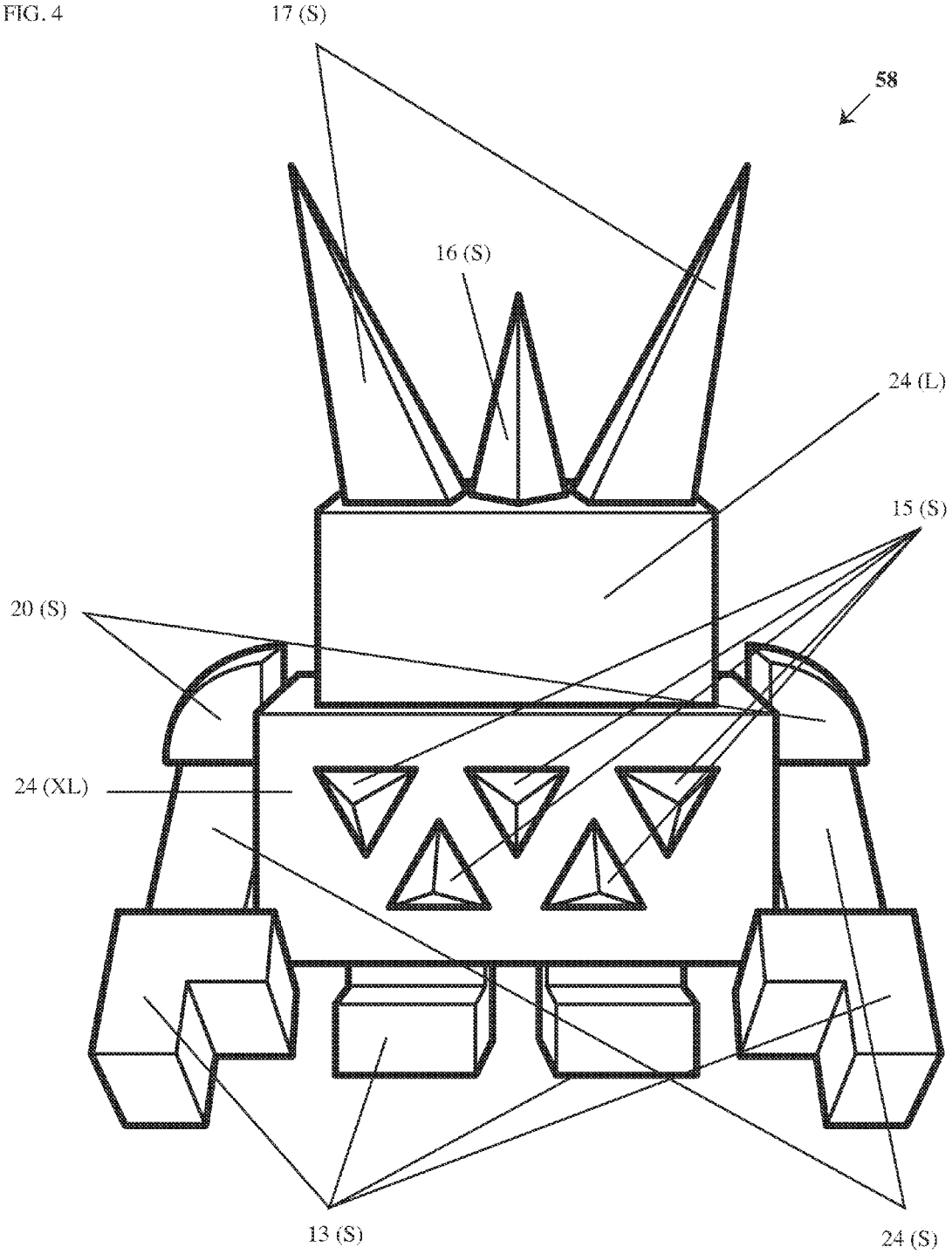
FIG. 4 illustrates a folded block structure in the form of a robot made using a number of the folded blocks of FIG. 1.

FIG. 4 illustrates a folded block structure 58 in the form of a stylized robot made from a number of folded blocks FB, the folded blocks made from associate blanks B. Specifically, and as illustrated in FIG. 4, two small folded blocks 17 (ears), one small folded block 16 (antenna), one large folded block 24 (head), five small folded blocks 15 (robot chest armor), two small folded blocks 24 (arms), two small folded blocks 20 (shoulders), two small folded block 13 (hands), and two small folded block 13 (feet), were used in constructing structure 58. The specific blanks B corresponding to some of these folded blocks FB are shown in more detail in FIG. 5.

Figure 5:
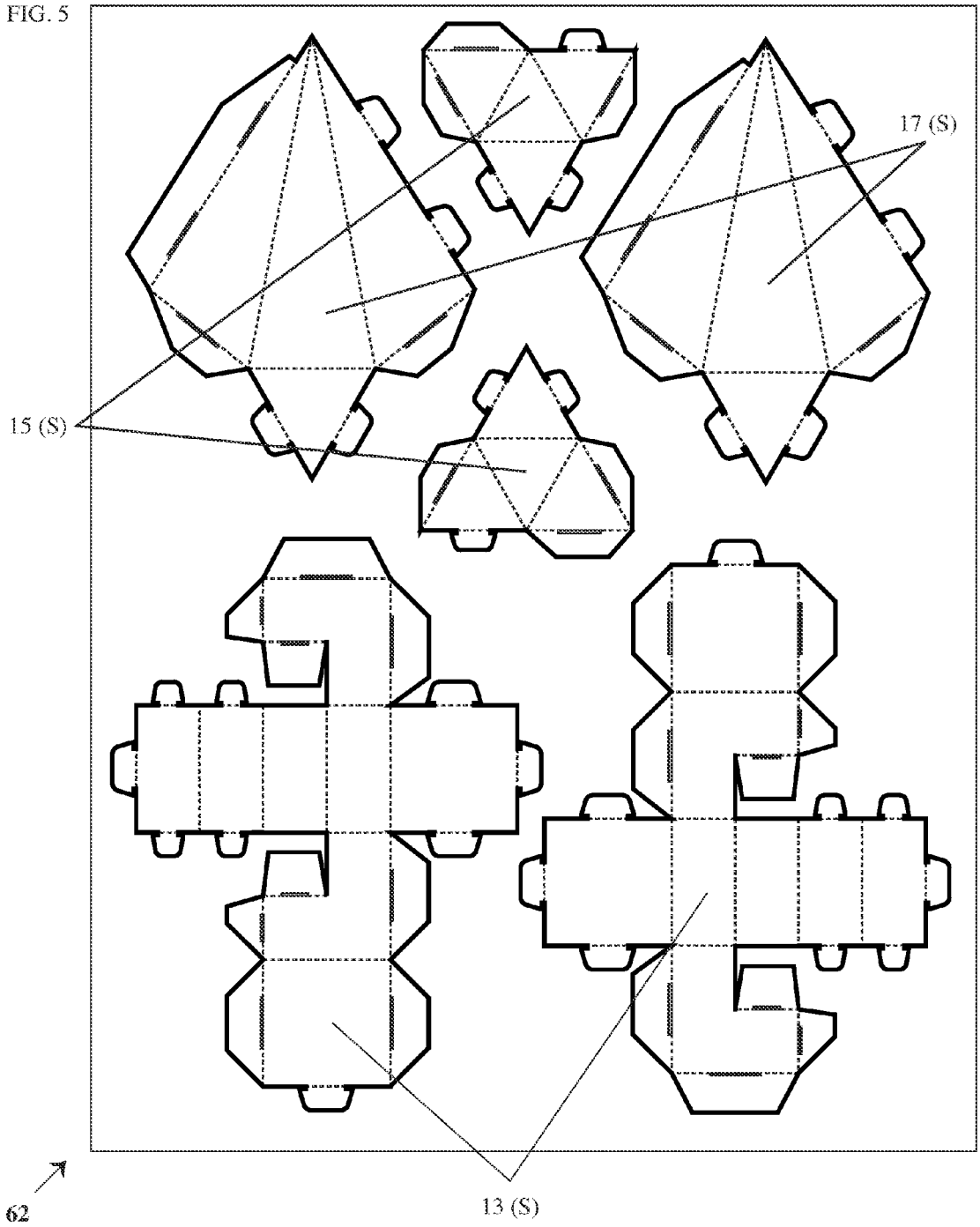
FIG. 5 is a plan view of a shape sheet including several of the blanks of FIG. 2 which are used in the robot form of FIG. 4.

FIG. 5 illustrates an example of what are referred to as shape sheets 62. The shape sheets contain blanks B sharply cut by appropriate processing means so that blanks B can be easily detached from the shape sheet without forcing a user to use a separate cutting tool. This differs from a conventional method of having a user directly cutting the shapes, by means of a cutting tool such as scissors and the like, which often does not make the edges of the cut blanks sharp, clear and accurate. Further, when blanks B are inexactly cut, the shapes may not be available for building the shape into an accurately created three dimensional, hollow folded block, thereby impeding the completion of the toy form itself. However, in the case of the shape sheet 62 for a blank B according to the present invention, such a problem has been overcome. The processing means mentioned above is preferably comprised of a mold knife. Using a mold knife as the processing means for cutting out the blanks B is particularly appropriate when the sheet material is made of recyclable paperboard, such as heavy paper or cardboard stock. The mold knife process also makes viable the tab/tab slits aspect of examples of the invention.

One example of a procedure for making folded block structure 58 is as follows. The user first removes a blank B, such as small blank 13, from a shape sheet 62 to create small folded block 13 serving as one of the robot's hands. In some examples, blanks B have ornamentation or other designs on one or both sides. This permits the user to select which side is to be exposed for use in creating the robot or other creation. The user then pre-folds the blank B along the side fold lines 36, tab fold lines 40 and flap fold lines 46. This pre-folding helps to begin placing blank B into its folded shape. In some examples, tabs 38 and the corresponding flaps 44 having the tab slits 50, which will receive the tabs, are marked to help guide the construction of the folded blocks FB. As shown in FIG. 3, tabs 38 may be marked with, for example, reference characters A, B, C, etc. and the tab slits 50 to which the tabs will be secured may be marked with like characters A, B, C, etc. Tabs 38 and tab slits 50 create a slit and tab system thereby connecting two sides 28 of the blank B at their tab edges 32 and flap edges 34, transforming the flat two-dimensional shape into a three dimensional hollow block. This procedure is repeated for each of the folded blocks FB needed to make a particular folded block structure 58, such as a robot shown in FIG. 4. Depending on the length of an edge, more than one tab may be used along one edge. However, folded blocks FB are constructed without the need for adhesives or other securing agents. Tabs 38 and tab slits 50 provide the necessary means for maintaining the folded blocks FB in their three-dimensional shapes.

After the folded blocks FB necessary to create the particular folded block structure 58 are created, they are adhered to one another typically using double-sided adhesive dots. Adhesive dots are conventional circles of adhesive captured between two release sheets. Other types of adhesive elements, which may be removable or permanent, may also be used. In some examples, adhesion may be through the use of magnetic adhesive elements.

Figure 6:
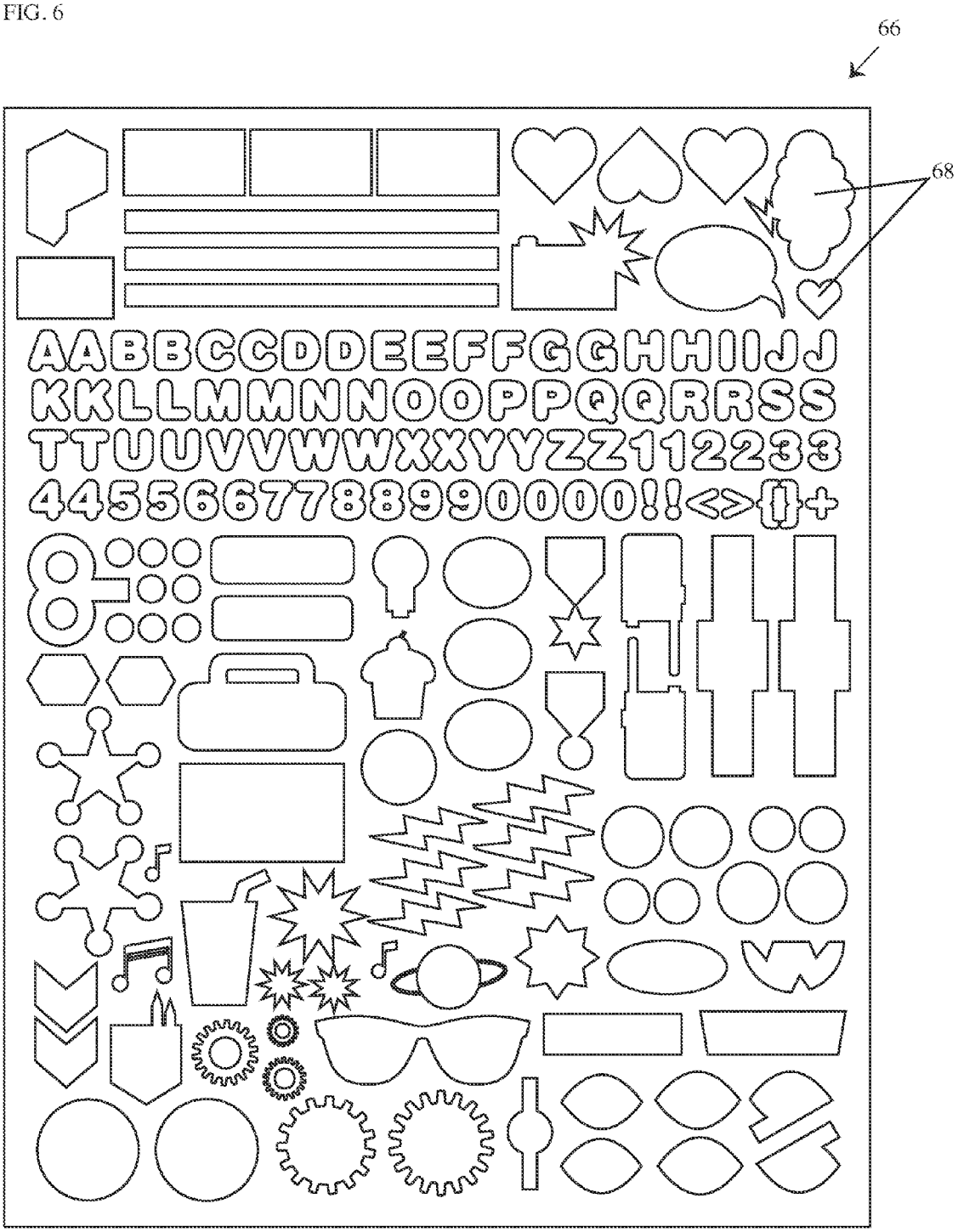
FIG. 6 is a plan view of a sticker sheet.

Additional ornamentation for decoration and customization may be added to the individual folded blocks FB or to the finished folded block structure 58, or to both. The additional ornamentation may be in the form of stickers removed from a sheet 66 of stickers 68, an example of which is shown in FIG. 6. Elements of the accessory sticker sheet 66 have cut lines created by a processing means so as to allow stickers 68 to be easily detached from sticker sheet 66 without using a separate cutting tool. In some examples, stickers 68 are arranged to the appropriate scale and size specific to the particular folded block structure 58 to be made. Sticker sheet 66 may be modified in various manners without departing form the technical idea or concept of the present invention. For example, sticker sheet 66 may be arranged differently depending on, for example, the size and shape of the folded blocks FB, or depending on a particular folded block structure 58 for which stickers 68 are designed.

In some examples, the various components required to create folded block structures are provided in the form of a kit. One example of a kit includes one or more shape sheets 62 containing a number of different blanks B. In this example, the kit may also include instructions for which blanks B will be needed to create a particular folded block structure 58, the folded block structure preferably shown in a completely assembled form and, optionally, shown in a series of partially completed forms to aid construction. In addition, the kit, in some examples, may include a supply of adhesive dots and a sheet of stickers for ornamentation. The kit may include only the blanks B necessary to create one or more specific folded block structures 58. Alternatively, the kit may include extra blanks B or the kit may include a variety of blanks B without any instructions on making a particular folded block structure 58.

As is apparent form the above description, folded block structures 58 are fabricated with the use of one or more shape sheets 62 on which a plurality of blanks B sharply cut by a processing means are arranged, and thus the blanks B for the toy are easily detached from the shape sheets 62. In addition, the detached blank B transforms from a flat two dimensional shape into a three dimensional hollow block, and accordingly, the present invention is effective in enhancing the user's dimensional and spatial thinking abilities as well as general math and engineering skills.

It is the intention of this invention to create an all inclusive user experience whereby no outside tools or other materials are typically needed to build a paper toy form in the form of folded blocks FB.

The shape sheets 62, the flattened two-dimensional format of the blanks B, and the various shapes and sizes of the shapes can be modified in various manners without departing form the technical idea or concept for the present invention. For example, the blanks B may be provided in a single shape sheet 62 or a plurality of shape sheets 62 depending on the size, shape and complexity of the folded block structure 58. The order or form of the blanks B arranged on the shape sheets 62 may also be modified as necessary. The number of the blanks B may be increased or decreased depending on the size and form of the folded block structure 58 selected.

One embodiment of the present invention described above, a robot, was referred to as an example for a folded block structure 58, sometimes referred to as a toy form. However, it is evident to one skilled in the art that the present invention can be applied to forms of all kinds including but not limited to a wide variety of animals, objects, automobiles, etc.

Although the preferred embodiments of the present invention have been disclosed for illustrative purposes, those skilled in the art will appreciate that various modifications, additions and substitutions are possible, without departing form the scope and spirit of the inventions as disclosed in the accompanying claims.

The invention claimed is:

1. A folded block structure comprising:

at least three different shaped folded blocks secured to one another to form at least a part of a folded block structure, each folded block comprising:

X sides, the sides having edges, the edges comprising separate side edges, tab edges and flap edges;

the sides joined to one another along adjacent ones of said side edges;

side folds lines at said side edges;

a tab extending from at least some of the tab edges;

tab fold lines at said tab edges;

a flap extending from each of the flap edges;

flap fold lines at said flap edges;

a tab slit at or near at least some of the flap folds lines, the tab slits being configured for receipt of the tabs; and each tab engaging a corresponding tab slit thereby creating a three-dimensional, fully enclosed, X-sided folded block structure; and at least one of the folded blocks having a curved side.

2. The folded block structure according to claim 1, wherein a plurality of tabs extend from at least one tab edge.

3. The folded block structure according to claim 1, wherein each edge is one of a side edge, a tab edge or a flap edge.

4. The folded block structure according to claim 1, wherein for each tab edge there is a corresponding flap edge.

5. The folded block structure according to claim 1, wherein the flaps extend along substantially the entire length of the flap edges.

6. The folded block structure according to claim 1, wherein:

the tab fold lines have ends; and notches are defined between the tabs and the tab edges at the ends of the tab fold lines.

7. The folded block structure according to claim 1, wherein the folded blocks are secured to one another using an adhesive.

8. The folded block structure according to claim 7, wherein the adhesive is effectively permanent adhesive.

9. The folded block structure according to claim 1, further comprising ornamental stickers for placement on at least one of the folded blocks in any manner selected by the user, thereby enabling the creation of a wholly unique toy formed by the user.

10. The folded block structure according to claim 1, wherein at least one of the sides of at least one of the folded blocks has first and second surfaces, both of said surfaces being ornamented.

11. The folded block structure according to claim 1, wherein the folded blocks are made of paperboard.

12. A method for making blanks for a folded block structure comprising:

making blanks for at least 3 three-dimensional, fully enclosed, different shaped folded blocks for assembly by a user, the blank making method for each different shaped folded block comprising:

selecting a shape for a folded block, the folded block having X side surfaces;

creating a blank comprising (1) X sides corresponding to the X side surfaces of the folded block to be made, the sides having edges, the edges comprising separate side edges, tab edges and flap edges, the sides joined to one another along adjacent ones of said side edges, (2) tabs extending from at least some of the tab edges, and (3) flaps extending from each of the flap edges;

creating side folds lines along the side edges, tab fold lines along the tab edges and flap folds lines along the flap edges;

forming tab slits at or near at least some of the flap folds lines; and configuring the tabs and the tab slits for receipt of the tabs by the tab slits, whereby a user can create the entire three-dimensional, fully enclosed folded block from the blank; and the blank making step comprising making at least one blank with curved edges so that the folded block created from said at least one blank has a curved side surface.

13. The method according to claim 12, further comprising creating instructions to aid a user in the creation of the folded blocks for the folded block structure.

14. The method according to claim 13, wherein the instructions creating step comprises creating instructions regarding the use of an adhesive in creating the folded block structure.

15. The method according to claim 13, wherein the instructions creating step comprises creating instructions for securing folded blocks one another using an adhesive.

16. The method according to claim 15, wherein the instructions creating step comprises creating instructions for the use of adhesive dots as the adhesive.

17. The folded block structure according to claim 7, wherein the folded blocks of the folded block structure are secured to one another with the adhesive and without the inter-engagement of a portion of one folded block with openings formed in an adjacent folded block.

18. The folded block structure according to claim 1 wherein:

said tabs extend from each of the tab edges; and said tab slits are at or near each of the tab fold lines.

19. The folded block structure according to claim 1, wherein said folded block having a curved side is in the shape of a segment of a cylinder.

20. The folded block structure according to claim 1, wherein the folded blocks include a six sided folded block having a first, second, third, and fourth sides joined together at 90° angles to form a tubular structure having first and second ends, a fifth side joined to the first end of the tubular structure and a sixth side joined to the second end of the tubular structure, the fifth and sixth sides being other than parallel to one another.

21. The folded block structure according to claim 1, wherein the folded blocks include a stairstep shape structure formed from a single blank, the stairstep shape structure including first and second parts extending from one another, the first being in the shape of a first rectangular prism and the second part being in the shape of a second rectangular prism.

22. A method for making a folded block structure from at least three different shaped folded blocks comprising:

forming blanks for at least three different shaped folded blocks according to claim 12;

creating at least three different shaped folded blocks from the blanks; and securing the at least three different shaped folded blocks to one another to create the folded block structure.

23. A kit for making a folded block structure comprising:

blanks for at least 3 three-dimensional, fully enclosed, different shaped folded blocks for assembly by a user, each blank comprising:

X sides corresponding to X side surfaces of the folded block to be made, the sides having edges, the edges comprising separate side edges, tab edges and flap edges, the sides joined to one another along adjacent ones of said side edges;

tabs extending from each of the tab edges;

flaps extending from each of the flap edges;

side folds lines along the side edges;

tab fold lines along the tab edges;

flap folds lines along the flap edges;

tab slits at or near each of the flap folds lines; and the tabs and the tab slits configured for receipt of corresponding ones of the tabs by the tab slits;

at least one of a blanks having curved edges;

whereby a user can create said at least three folded blocks from the blanks to create a folded block structure with the folded block created from the at least one of the blanks having a curved side surface.

24. The kit according to claim 23, wherein said curved edges are tab edges.

25. A folded block structure comprising:

at least three different shaped folded blocks secured to one another to form at least a part of a folded block structure, each folded block comprising:

X sides, the sides having edges, the edges comprising separate side edges, tab edges and flap edges;

the sides joined to one another along adjacent ones of said side edges;

side folds lines at said side edges;

a tab extending from at least some of the tab edges;

tab fold lines at said tab edges;

a flap extending from each of the flap edges;

flap fold lines at said flap edges;

a tab slit at or near at least some of the flap folds lines, the tab slits being configured for receipt of the tabs; and each tab engaging a corresponding tab slit thereby creating a three-dimensional, fully enclosed, X-sided folded block structure; and the folded blocks include a six sided folded block having a first, second, third, and fourth sides joined together at 90° angles to form a tubular structure having first and second ends, a fifth side joined to the first end of the tubular structure and a sixth side joined to the second end of the tubular structure, the fifth and sixth sides being other than parallel to one another.

26. A folded block structure comprising:

at least three different shaped folded blocks secured to one another to form at least a part of a folded block structure, each folded block comprising:

X sides, the sides having edges, the edges comprising separate side edges, tab edges and flap edges;

the sides joined to one another along adjacent ones of said side edges;

side folds lines at said side edges;

a tab extending from at least some of the tab edges;

tab fold lines at said tab edges;

a flap extending from each of the flap edges;

flap fold lines at said flap edges;

a tab slit at or near at least some of the flap folds lines, the tab slits being configured for receipt of the tabs; and each tab engaging a corresponding tab slit thereby creating a three-dimensional, fully enclosed, X-sided folded block structure; and the folded blocks include a stairstep shape structure formed from a single blank, the stairstep shape structure including first and second parts extending from one another, the first being in the shape of a first rectangular prism and the second part being in the shape of a second rectangular prism.

* * * * *